United States Patent [19]

Van de Caveye et al.

[11] Patent Number: 4,576,561

[45] Date of Patent: Mar. 18, 1986

[54] DEVICE FOR ADJUSTING THE HEIGHT OF BUILDING BLOCKS

[75] Inventors: Yves Van de Caveye, Waterloo, Belgium; Henri Schaeflé, Clermont, France

[73] Assignee: Hanota Holdings S.A., Luxembourg, Luxembourg

[21] Appl. No.: 467,830

[22] PCT Filed: Jun. 11, 1982

[86] PCT No.: PCT/BE82/00016

§ 371 Date: Feb. 18, 1983

§ 102(e) Date: Feb. 18, 1984

[87] PCT Pub. No.: WO83/00028

PCT Pub. Date: Jan. 6, 1983

[30] Foreign Application Priority Data

Jun. 22, 1981 [BE] Belgium ..... 205169

[51] Int. Cl.[4] ..... B28B 11/04

[52] U.S. Cl. ..... 425/104; 425/105; 425/141; 425/220; 425/367

[58] Field of Search ..... 264/256; 425/220, 357, 425/145, 94, 105, 106, 110, 254, 367, 259, 104, 253, 141

[56] References Cited

U.S. PATENT DOCUMENTS

| | | | |
|---|---|---|---|
| 1,284,670 | 11/1918 | Haws | 425/220 |
| 1,570,594 | 1/1926 | Stevens | 425/106 |
| 2,320,728 | 6/1943 | Hume | 425/357 |
| 2,719,346 | 10/1955 | Caciagli | 425/456 |
| 3,824,055 | 7/1974 | Shoe et al. | 425/220 |
| 3,963,397 | 6/1976 | Cruzen et al. | 425/253 |
| 4,101,255 | 7/1978 | Fernaeus et al. | 425/220 |
| 4,255,104 | 3/1981 | Stinton | 425/111 |
| 4,256,446 | 3/1981 | Hinojosa et al. | 425/94 |
| 4,411,723 | 10/1983 | Takeuchi | 264/256 |

FOREIGN PATENT DOCUMENTS

| | | |
|---|---|---|
| 2440258 | 5/1980 | France . |
| 2037648 | 7/1983 | United Kingdom . |

*Primary Examiner*—Jay H. Woo
*Assistant Examiner*—James C. Housel
*Attorney, Agent, or Firm*—Weiser & Stapler

[57] ABSTRACT

A device for adjusting the height of building blocks or similar, which operates to form inside a mold blocks the height of which varies between a predetermined height and a height which is lower than the predetermined height, laying over the blocks an amount of material the height of which is higher than the height difference between the predetermined height and the actual height of the blocks, and levelling the material amount until the total height of the blocks as formed by the sum of the actual block height and the height of the material amount substantially corresponds to the predetermined height.

20 Claims, 1 Drawing Figure

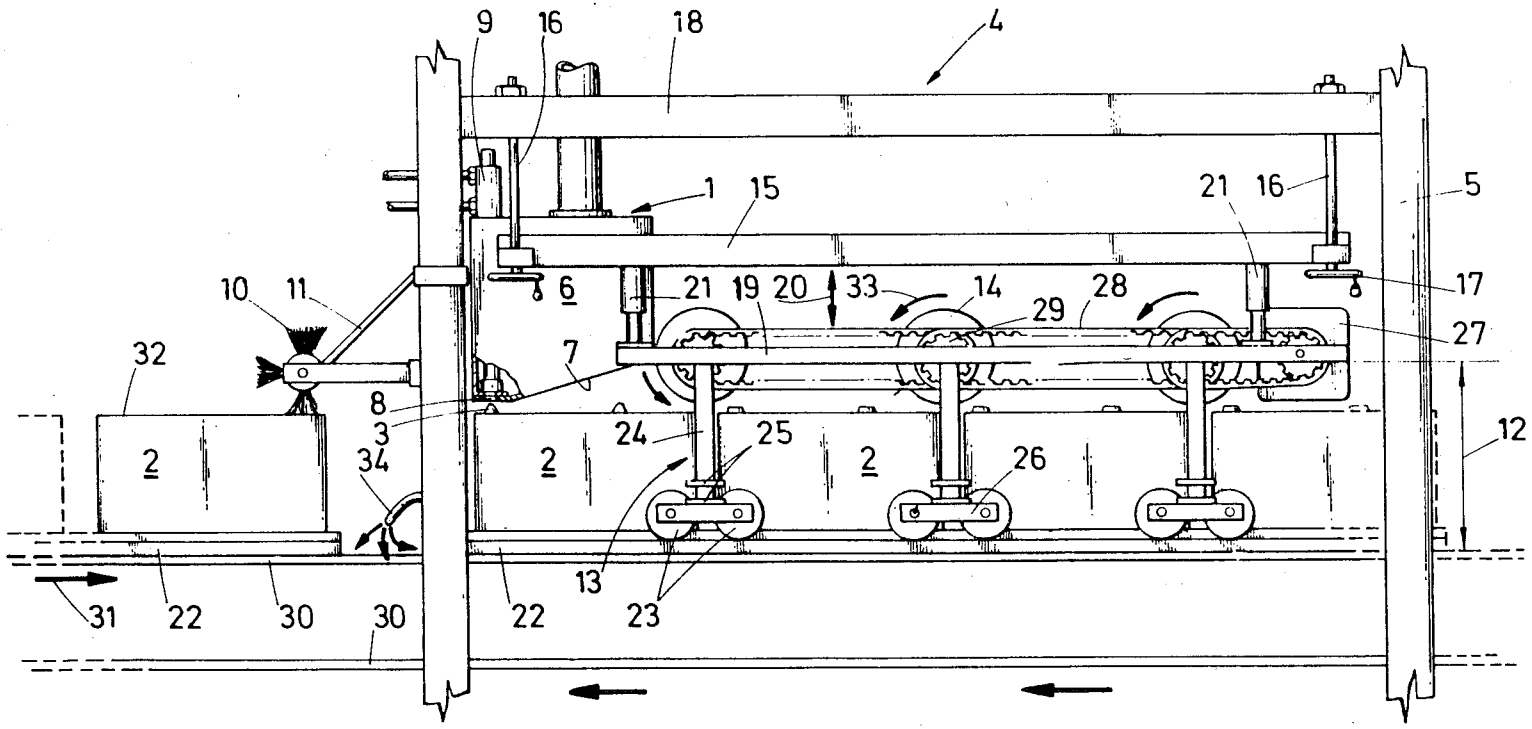
4
5
17
27
12
16
21
28
29
14
33
20
19
15
1
18
21
6
7
16
9
8
3
34
11
10
32
2
2
2
26
25
24
13
23
22
22
30
30
31

DEVICE FOR ADJUSTING THE HEIGHT OF BUILDING BLOCKS

This invention relates to a method for adjusting at a predetermined value, the height of building blocks and similar, notably concrete blocks which are to be laid dry upon one another to be filled or not thereafter with a binder, by laying over the top sides of the blocks an amount of material which is hardenable and bindable thereon, with a height which is higher than the difference between said predetermined height and the actual height of said block, and levelling thereafter said material amount over said block sides before hardening thereof until the total block height formed by the sum of said block height and said material height, substantially corresponds to said predetermined height.

This invention has for an object to provide a method of the above-defined kind which might easily be adapted to all of the known methods for manufacturing building blocks, notably concrete blocks in a static press.

For this purpose the method according to the invention comprises in sequence, forming inside a mould blocks the height of which varies between said predetermined height and a height which is lower than said predetermined height, laying over the green, still moist blocks an amount of said material the height of which is higher than the height difference between said predetermined height and the actual height of that block being considered, and levelling said material amount until the total height of said block as formed by the sum of the actual block height and the height of said material amount substantially corresponds to the predetermined height, said blocks moving substantially continuously at least from that moment where they come out of the moulds up to said laying of material over said blocks.

The invention further pertains to a device for the working of the above-defined method, that is a device for adjusting in the height building blocks and similar notably hollow blocks to be laid dry upon one another comprising a metering apparatus for laying over the top sides of said blocks, an amount of material which is hardenable and bindable thereon, and a levelling apparatus for tamping down said material over the blocks, to impart to said blocks a total height which substantially corresponds to a predetermined height.

Said device comprises a conveyor for the blocks extending from a press inside which said blocks are formed, and moving substantially continuously through said levelling apparatus, a levelling member above a space wherein said blocks are brought by the conveyor to tamp down that material laid down on said blocks by said metering apparatus, and spacing or guiding means allowing to retain said member at such a distance relative to the bottom block side which substantially corresponds to said predetermined height, during the tamping down of said material laid over the blocks.

Advantageously, said levelling member comprises at least one substantially horizontal cylinder which is so operated as to have each point on the cylinder-shaped surface generate a cycloidal curve relative to the blocks, that is said cylinder does roll without slipping on that material which has been laid over said blocks.

In a particular embodiment of the invention, said spacing or guiding means are fixed relative to said levelling member and cooperate with a plate or board bearing said blocks to be adjusted at that time where the cylinder lies in the low position thereof, that is adjacent to the top surface of said blocks, the spacing between that portion of the levelling member used for tamping down the material on the blocks, and that portion of the spacing or guiding means used to cooperate with a plate or board bearing the blocks to be adjusted being substantially equal to the predetermined total height of said blocks.

Other details and features of the invention will stand out from the following description given by way of non limitative example and with reference to the accompanying drawing, which shows diagrammatically in elevation, a particular embodiment of a device for adjusting in the height building blocks.

The invention has essentially for object the manufacturing of concrete blocks and mostly of light concrete blocks, for example on the basis of expanded clay, having at least one hollow space extending through the blocks over the whole height thereof, and which can be assembled dry to form depending channels inside which a binder such as concrete, may be poured.

Over the top sides of said blocks is laid down an amount of material which is hardenable and bindable thereon, preferably a product on the basis of cement and notably pure cement, with a height which will be higher than the difference between some predetermined or required height and the actual height of that block being considered, and said material is tamped down partly at least on said block sides before hardening of said material, until the total height of said block substantially corresponds to said predetermined or required height, said total height being formed by the sum of the actual height of said blocks and the height of said tamped material amount.

Said material is laid over the blocks as soon as said blocks leave the press, that is before drying thereof, in such a way that said material might harden and be secured to said blocks partly at least under the action of the moisture contained in the blocks proper.

In the case of hollow blocks to be dry-assembled and inside which concrete has possibly to be poured, on the top edges of each said blocks are formed at least four small heaps of cone shape from said material, which are so distributed as to comprise a stable basis for the superimposing of said blocks, for example in the case of blocks having a portion of parallelepiped shape extended at the one end thereof by a fork, said heaps might advantageously be provided adjacent the corners of the parallelepiped portion.

Said heaps are then tamped down until the total height of the blocks substantially corresponds to the predetermined or required height.

There is first formed by means of a static press, blocks the height of which is lower by 1 to 2 mm for example, than said predetermined height.

Thereafter, over the blocks coming out of the press, which are thus still moist, is laid down an amount, for instance in the shape of heaps, from said material, notably powdered cement, the height of which is higher than the difference between said predetermined height and the actual height of the block being considered.

During a following step, said material amount is levelled notably by means of a roller or cylinder, until the total height of said blocks which is formed by the sum of the actual height thereof and the material amount height, substantially corresponds to the predetermined height.

During a final step, the blocks thus adjusted in the height thereof, are subjected to drying and hardening.

According to the invention, the blocks move substantially continuously at the outlet from the press and preferably both during the laying down of the material heaps on the top surface of the blocks and during the levelling of said heaps.

Said blocks are notably formed inside the static press on plates, so-called boards which at the outlet from the press, more over a conveyor formed by two endless chains in parallel relationship to which a continuous movement is imparted.

Said method thus has the advantage of not lowering the throughput of the blocks in the static press, the laying down of the material over the blocks and the levelling of said material being preferably performed without stopping the movement of the blocks as they come out of the press.

Said levelling is advantageously made by means of a cylinder which rolls without slipping, above the blocks at said predetermined height.

The accompanying FIGURE shows diagrammatically a particular embodiment of a device for the working of the above-defined method.

Said device essentially comprises a metering apparatus 1 for laying down on the top sides of blocks 2, an amount of material in the shape of cones 3, and a levelling apparatus 4 for tamping down said cones over the blocks, in such a way as to give to said blocks a total height which substantially corresponds to said predetermined or required height. Said device is arranged at the outlet from a static press, not shown, for manufacturing concrete blocks.

The metering apparatus 1 and the levelling apparatus 4 are arranged in series on one and the same rigid frame 5 to form a single unit.

The metering apparatus comprises a hopper 6 with slanted bottom 7 for containing the powdered product notably cement, to be laid over the blocks.

Said hopper is provided at the bottom thereof with a series of holes 8 which each cooperate with a discrete closure member 9 which allows adjusting the amount of product passing through each such openings.

Said metering apparatus 1 is preceded by a cylinder-shaped brush 10 hanging from said frame 5 at a height which is adjustable by means of screw ties 11.

The levelling apparatus 4 comprises a levelling member above a space 12 inside which said blocks 2 can be fed to flatten the cones 3, laid down on the blocks by the hopper 6 from said metering apparatus 1.

Moreover spacing or guiding members 13 are provided to hold the levelling member at a distance from the lower block side which corresponds substantially to said predetermined height during the flattening of the material laid down on said blocks.

Said levelling member comprises in the embodiment as shown in the figure, three identical cylinders 14 the axes of which extend in the same substantially horizontal plane. Said cylinders are so moved about the axes thereof as to have each point on the cylinder-shaped surface thereof generate a cycloidal curve relative to the blocks, that is roll without slipping over the material laid down thereon.

There is thus required a substantially perfect synchronizing between the revolution speed of cylinder 14 and the feeding speed of blocks 12 inside space 12.

Said levelling apparatus 4 further comprises a sliding framing 15 hanging through screws 16 controlled by hand wheels 17, from a framing of said frame 5.

The cylinders 14 are mounted in turn inside a frame 19 to which may be imparted an up and down motion as shown by arrows 20, relative to framing 15, between an upper position in which the cylinders lie in a rest condition, and a lower position in which the cylinders can perform said flattening operation.

Such up and down motion of frame 19 occurs by means of bellows jacks 21.

The spacing or guiding means 13 are fixed relative to said frame 19 bearing the cylinders 14 and cooperate with the plate or board 22 bearing said blocks 2 to be adjusted when the cylinders lie in the lower position thereof, that is adjacent the top surface of said blocks. This is the position as shown in the figure.

In this particular embodiment, the spacing and guiding means comprise wheels or rollers 23 arranged on the lower end of a vertical section 24 welded to said frame 19. Two such wheels or rollers 23 are provided in the figure for each cylinder 14 and extend on either side of the vertical symmetry plane which passes through the cylinder axis.

Means are provided to adjust the spacing between the cylinders and the wheels or rollers. In the embodiment as shown in the figure, said means are comprised of machined shims 25 which can be arranged between the lower end of said section 24 and bearings 26 secured thereto and bearing the revolution shaft of said wheels or rollers 23.

Such means might for example be used to adapt the spacing between the cylinders 14 in the lower position thereof, and the boards 22 with which cooperate the rollers or wheels 23 in such position.

Said wheels or rollers 23 rotate freely about the axis thereof in the bearings 26, while the cylinders 14 are driven through a motor-reducer 27 controlled by a built-in frequency changer. Such drive is obtained through notched belts 28 passing over pinions 29 mounted on the revolution shaft from the various cylinders 14.

Said drive is so designed that as the cylinders lie in one lower position thereof, they may roll without slipping on the blocks 2, that is in such a way that each point from the cylinder-shaped surface of the cylinders 14 generates a cycloidal curve.

The operation of said device is thus very simple

As a board 22 of blocks 2 comes out from the static press, it is moved by a conveying belt 30 through the adjusting device according to the invention which is arranged downstream of the press.

Said conveying belt 30 which is preferably formed by two endless chains in parallel relationship, continuously moving along the direction of arrow 31, first conveyes the blocks underneath the brush 10 which removes from the top block surface 32, the main portion of the fins.

Thereafter the blocks automatically pass continuously underneath the holes 8 of the hopper 6 from the metering apparatus 1 and cement heaps 3 of cone shape are laid down in accurate locations on the top surface 32 of said blocks.

The board 22 then passes, still substantially continuously, into the space 12 from the levelling apparatus 4. At this time, the frame 19 bearing the cylinders 14 is subjected to a lowering motion by means of the jacks 21 until that moment where the wheels or rollers 23 meet the board and roll freely thereon, such lowering being for example in the range from 0.5 to 1 cm.

In said position the cylinders driven by the motor-reducer 27, roll on the blocks 2 along the direction of arrows 33 to flatten the cement heaps 3 to a predetermined height from the top surface of board 22.

To prevent sand, granulates or similar lying on the rolling path of the wheels or rollers 23 from said board, a blowing device 34 is provided on the frame 5 at the inlet to space 12, to sweep said rolling path.

Due to said screws 16, the levelling apparatus and the metering apparatus may easily be put out of action. The movable framing 15 bears not only the frame 19, but also the hopper 6.

It is also of importance to provide efficient means for cleaning the rollers, for example scrapers not shown, acting on the cylinder-shaped surfaces of the cylinders as said cylinders lie in the upper position, that is the unoperating position thereof.

On the other hand it might be useful in some cases to provide discrete means to retain the boards and the levelling member in a substantially horizontal position and to prevent for example a tipping as the wheels or rollers 23 contact said boards.

It might also be useful when a plurality of cylinders 14 are being used as in the embodiment shown in the figure, to mount each cylinder on an independent frame 19 which is controlled separately to let the wheels or rollers 23 come down but when a board lies underneath the corresponding cylinder.

It must be understood that the invention is in no way limited to the above-described embodiment and that many changes may be brought thereto without departing from the scope of the invention as defined by the appended claims.

For instance the spacing and guiding means might be replaced by a twin conveying belt between which are held the lengthwise edges of the boards 22 as they pass through space 12, and in which the boards are retained constantly spaced relative to fixed supports against which the frame 19 may butt in the lowermost position thereof, to lie at said predetermined distance allowing to adjust said blocks 2 in the height. It would for instance be enough to provide a lower conveying belt which allows to press the board against an upper conveying belt moving inside guide rails, or else a rolling way above both lengthwise edges of said boards.

Another variation lies in using a levelling member which is fixed in the height, but comprises rollers undergoing a translation along the block movement direction, while providing conveying means which are separate from conveyor 30, said conveyor moving substantially continuously, to allow releasing for a time said boards from conveyor 30 to retain the boards for a short time interval in a stationary position at a well determined distance corresponding to said required height, from said cylinders 14 when the cylinders flatten said cones 3. Such a momentary stoppage might also be provided in the metering apparatus.

Finally, said adjusting method is not necessarily limited to hollow blocks to be filled with concrete or any other binder, but can be applied to any type of blocks, hollow or not, which may preferably be laid down dry upon one another in a wall structure.

We claim:

1. In a device for adjusting to a predetermined height building blocks and similar blocks, notably hollow blocks to be laid dry upon one another, said blocks having been formed in a mould and then unmoulded, which comprises a metering means for laying over a top of a succession of said unmoulded blocks an amount of material which is hardenable and bindable thereon, a levelling means for tamping down said material over the blocks for imparting to said blocks a total height which substantially corresponds to said predetermined height, and conveyor means adapted for moving the blocks from the mould inside which said blocks are formed and through said levelling means, an improved levelling means comprising, a levelling member spaced above a location wherein said unmoulded blocks are brought by the conveyor means to tamp down the material laid down on said blocks by said metering means, and guiding means cooperating with a top surface directly bearing the blocks to be adjusted for spacing said member at a fixed distance relative to and in accordance with the bottom of the blocks which substantially corresponds to said predetermined height, during the levelling of said material laid over the blocks.

2. The device as defined in claim 1, in which said levelling member comprises at least one substantially horizontal cylinder which is operated so as to have each point on the cylinder-shaped surface generate a cycloidal curve relative to the blocks, said cylinder rolling without slipping on the material which has been laid over said blocks.

3. The device as defined in claim 1, in which said cylinder is mounted on an adjustable frame, said frame being adjustable in the height relative to the blocks to be adjusted, so as to let the lower cylinder generatrix generate a reference plane which extends at said distance from the lower side of said blocks.

4. The device as defined in claim 1, in which said levelling member is movable in the height, the spacing or guiding means being fixed relative to said levelling member and cooperating with the top surface of a plate or board bearing the blocks to be adjusted, whereby at that time where said member lies in the lower position thereof and adjacent the top surface of said blocks, the spacing between that portion of the levelling member used to flatten the material over the blocks and that portion of the spacing or guiding means used for cooperating with said plate or board bearing the blocks to be adjusted being substantially equal to said total predetermined height of the blocks.

5. The device as defined in claim 4, in which said spacing and guiding means comprise wheels or rollers which are arranged at a fixed distance relative to said levelling member and move over the top surface of the plate or board bearing the blocks to be adjusted when said member lies in the lower position thereof.

6. The device as defined in claim 1, which further comprises means for adjusting said distance corresponding to the predetermined block height.

7. The device as defined in either one of claims 5 and 6, in which the wheels or rollers are mounted substantially symmetrically relative to the vertical plane passing through the axis of each cylinder from said levelling member.

8. The device as defined in claim 5, in which said wheels or rollers rotate freely about an axis which extends substantially in parallel relationship with the cylinder axis, said cylinder being driven through a motor-reduction gear controlled by a frequency changer.

9. The device as defined in claim 5, which further comprises at least one scraper per cylinder for cleaning the cylinder surface in the upper position thereof.

10. The device as defined in claim 1, in which said conveyor means is capable of substantially continuously moving said blocks through said levelling means.

11. The device as defined in claim 1, in which said blocks are transported through said levelling means on a plurality of boards, and said guiding means is capable of resting on the surfaces of said boards.

12. The device as defined in claim 11, in which said boards are spaced from one another on said conveyor means.

13. The device as defined in claim 11, in which said boards have irregular surfaces, and said guiding means is capable of continuously placing said levelling member at said predetermined height in accordance with variations in said board surfaces.

14. The device as defined in claim 11, in which said guiding means is a spacing member attached to and depending from said levelling member, the opposite end of which includes means for following the board surfaces on which said blocks are positioned.

15. The device as defined in claim 14, in which said levelling member is a rotating cylinder, positioned within said spacing member.

16. The device as defined in claim 14, in which said following means are wheels or rollers adapted for contacting said board surfaces.

17. A device for adjusting to a predetermined height the height of building blocks and similar blocks to be laid dry upon one another, said blocks having been formed in a mould so as to have an actual height which is less than said predetermined height and then unmoulded, which comprises, a metering means for laying over a top side of a succession of said unmoulded blocks forming the top edge of the block upon which superimposed blocks bear in a block wall construction an amount of powdered material which is hardenable and bindable thereon, a levelling means for tamping down said material over the blocks and adapted for continuously imparting to said blocks a total height which substantially corresponds to said predetermined height, conveyor means for substantially continuously moving the unmoulded blocks through said levelling means on a supporting board, said levelling means having a levelling member spaced above a location wherein the unmoulded blocks are brought by the conveyor means to tamp down the material laid down on said blocks by said metering means, said levelling member comprising at least one substantially horizontal cylinder mounted in a height adjustable frame, said cylinder being capable of operating so as to have each point on the cylinder-shaped surface generate a cycloidal curve relative to the blocks, and guide means fixed relative to said frame and cooperating with a top surface of the board bearing the blocks to be adjusted so that the spacing between a reference plane generated by the lower cylinder generatrix extending at a distance relative to the bottom of the blocks resting on the board substantially corresponds to said predetermined height.

18. The device according to claim 17 wherein the conveyor is adapted for continuously moving spaced apart blocks.

19. In a device for adjusting to a predetermined height building blocks and similar blocks, notably hollow blocks to be laid dry upon one another, said blocks having been formed in a mould and then unmoulded, which comprises a metering means for laying over a top of said succession of spaced apart, unmoulded blocks an amount of material which is hardenable and bindable thereon, a levelling means for tamping down said material over the blocks for imparting to said blocks a total height which substantially corresponds to said predetermined height, and conveyor means for moving the blocks from the mould inside which said blocks are formed and through said levelling means, an improved levelling means comprising, at least one rotating cylinder mounted above a location wherein said unmoulded blocks are brought by the conveyor means to tamp down the material laid down on said blocks by said metering means, means for synchronizing the revolution speed of said cylinder and the conveyor speed feeding said blocks into said tamping location, and guiding means cooperating with a top surface directly bearing the blocks to be adjusted for spacing said member at a fixed distance relative to and in accordance with the bottom of the blocks which substantially corresponds to said predetermined height, during the levelling of said material laid over the blocks.

20. The device as defined in claim 10, in which said conveyor means is capable of substantially continuously moving said blocks through said levelling means.

* * * * *